US007757701B2

(12) United States Patent
Shiotsuki et al.

(10) Patent No.: US 7,757,701 B2
(45) Date of Patent: Jul. 20, 2010

(54) ULTRASONIC CLEANING METHOD AND DEVICE

(75) Inventors: Sadamu Shiotsuki, Nishio (JP); Koichi Yokoyama, Nagoya (JP)

(73) Assignee: Denso Corporation, Kariya (JP)

( * ) Notice: Subject to any disclaimer, the term of this patent is extended or adjusted under 35 U.S.C. 154(b) by 903 days.

(21) Appl. No.: 11/589,392

(22) Filed: Oct. 30, 2006

(65) Prior Publication Data

US 2007/0102020 A1 May 10, 2007

(30) Foreign Application Priority Data

Nov. 7, 2005 (JP) ..... 2005-321909

(51) Int. Cl.
*B08B 7/02* (2006.01)
*B08B 7/04* (2006.01)

(52) U.S. Cl. ..... 134/184; 134/1; 134/902

(58) Field of Classification Search ..... 134/1, 134/1.3, 10, 34, 184, 902
See application file for complete search history.

(56) References Cited

U.S. PATENT DOCUMENTS 4,543,130 A * 9/1985 Shwartzman ..... 134/1
5,071,776 A * 12/1991 Matsushita et al. ..... 438/460
5,090,432 A * 2/1992 Bran ..... 134/139
5,361,787 A * 11/1994 Miyazaki et al. ..... 134/57 R
5,365,960 A * 11/1994 Bran ..... 134/184
5,379,785 A * 1/1995 Ohmori et al. ..... 134/184
5,534,076 A * 7/1996 Bran ..... 134/1
6,026,382 A * 2/2000 Kalthoff ..... 705/35
6,098,643 A * 8/2000 Miranda ..... 134/186
6,138,698 A * 10/2000 Tanaka et al. ..... 134/184
6,523,557 B2 * 2/2003 Struven ..... 134/184

FOREIGN PATENT DOCUMENTS

JP 56-53786 5/1981
JP 63-39487 3/1988
JP 64-058389 3/1989

(Continued)

OTHER PUBLICATIONS

Office action dated Feb. 13, 2009 in Chinese Application No. 2006 101 63545.X.

(Continued)

*Primary Examiner*—Alexander Markoff
(74) *Attorney, Agent, or Firm*—Harness, Dickey & Pierce, PLC

(57) ABSTRACT

An ultrasonic cleaning device (50) comprises: an ultrasonic oscillation plate (2) having a plurality of ultrasonic oscillators (1); an ultrasonic wave guide chamber (3) for collecting an ultrasonic wave force generated by the ultrasonic oscillation plate; and a cleaning tank (4) in which a cleaning solution (20) is stored, wherein an object (5) to be cleaned is cleaned when it is dipped in the cleaning tank. Since an upper portion of the ultrasonic wave guide chamber is airtightly closed with the upper face (31) and formed into a bowl shape, an air layer (10) is formed between a liquid level of the cleaning solution in the ultrasonic wave guide chamber and the upper face (31). The cleaning tank is joined to the ultrasonic wave guide chamber, and an ultrasonic oscillation plate is arranged so that it can be opposed to the ultrasonic wave guide chamber.

8 Claims, 2 Drawing Sheets

FOREIGN PATENT DOCUMENTS

| | | |
|---|---|---|
| JP | 3-77319 | 4/1991 |
| JP | 4-197433 | 7/1992 |
| JP | 06-333906 | 12/1994 |
| JP | 10-128256 | 5/1998 |
| JP | 10-192800 | 7/1998 |
| JP | 2004-130259 | 4/2004 |

OTHER PUBLICATIONS

Office Action dated Aug. 21, 2009 in copending Chinese Patent Application No. 200610163545.X with English translation.

Office action dated Jan. 5, 2010 in corresponding Japanese Application No. 2005-321909.

* cited by examiner

ULTRASONIC CLEANING METHOD AND DEVICE

BACKGROUND OF THE INVENTION

1. Field of the Invention

The present invention relates to an ultrasonic cleaning method and device. More particularly, the present invention relates to an ultrasonic cleaning method and device suitably used for a process in which it is necessary to clean a mechanically machined part in the shortest period of time.

2. Description of the Related Art

In the case of machining a product, it is necessary to conduct cleaning to remove foreign objects such as chips and to remove oil and fat used for supporting a machining process. This cleaning is needed not only for manufacturing a machined product but also for manufacturing an electric appliance. An ultrasonic cleaning method of cleaning an object to be cleaned, which is put in water or solvent, by utilizing ultrasonic waves of high frequencies is widely used in the industrial field. The ultrasonic cleaning method described above is especially suitable for cleaning an object, the shape of which is so complicated that it is difficult to conduct cleaning by a method in which fluid is jetted onto the object to be cleaned. The ultrasonic cleaning method described above is also suitable for cleaning a fragile object. Even in the field to which ultrasonic cleaning method is suitably applied, as a product may be accurate and complicated, it may be required to conduct highly accurate and more complete cleaning. As a result, it may be required to conduct more effective cleaning.

According to the conventional ultrasonic cleaning method, in order to enhance a cleaning force (ability) with respect to an object to be cleaned, the number of oscillators, which are attached to a unit area of an oscillation plate, is increased, and an input of electric power into an ultrasonic oscillator is increased, so as to enhance an ultrasonic force (a cleaning force) produced by the ultrasonic oscillation plate. However, according to this method, an excessively heavy load is given to the ultrasonic oscillator and the ultrasonic oscillation plate. Accordingly, these components are likely to be damaged and abraded in a short period of time. Even when deaerated liquid is utilized, the liquid temperature is controlled at an appropriate temperature and the most appropriate cleaning solution is selected for removing contamination, in order to obtain an ultrasonic force of the maximum intensity, a problem that an excessively heavy load is required to be applied to the ultrasonic generator for controlling the oscillation of ultrasonic waves occurs. Due to the physical limits described above, it was difficult to conduct a high speed cleaning operation by increasing an ultrasonic force (a cleaning force) in the prior art.

SUMMARY OF THE INVENTION

The present invention has been accomplished in view of the above circumstances. It is an object of the present invention to provide an ultrasonic cleaning method and device capable of realizing high speed cleaning by enhancing an ultrasonic force even when an input of electric power, the intensity of which is as high as that of the conventional ultrasonic cleaning method and device, is used.

It is another object of the present invention to provide an ultrasonic cleaning device, the size of which can be greatly reduced by downsizing a cleaning tank.

According to a first aspect of the present invention, in order to accomplish the above object, an ultrasonic cleaning device (50) comprises: an ultrasonic oscillation plate (2) having a plurality of ultrasonic oscillators (1); an ultrasonic wave guide chamber (3) for collecting an ultrasonic wave force generated by the ultrasonic oscillation plate (2); and a cleaning tank (4), in which a cleaning solution (20) is stored, for cleaning an object (5) to be cleaned when it is dipped in the cleaning solution (20).

Due to the above constitution, especially when a mechanism, by which an ultrasonic force (ability) is condensed and concentrated on the cleaning tank by providing the ultrasonic wave guide chamber, is utilized, it is possible to enhance a cleaning force of the ultrasonic cleaning device without causing a problem of damage and failure of the ultrasonic oscillator and the ultrasonic generator which could be a problem when a conventional ultrasonic cleaning force is strengthened. Accordingly, a cleaning speed of the ultrasonic cleaning device can be remarkably enhanced and the cleaning device can be downsized in comparison with conventional devices and, further, the cost of cleaning can be reduced.

According to a second aspect of the present invention, in an ultrasonic cleaning device of the first aspect, the ultrasonic wave guide chamber (3) the upper portion of which is airtightly closed by its upper face (31) is formed into a bowl-shape. Therefore, an air layer (10) is formed between a liquid level of the cleaning solution in the ultrasonic wave guide chamber and the upper face (31). The cleaning tank (4) is joined to the ultrasonic wave guide chamber, and the ultrasonic oscillation plate is arranged so that it can be opposed to the ultrasonic wave guide chamber.

According to this aspect, a configuration in which the oscillation generated by the ultrasonic oscillation plate is reflected on a liquid level of the ultrasonic wave guide chamber and the ultrasonic force is condensed and collected is clarified.

According to a third aspect of the present invention, in the second aspect, a lower portion of the cleaning tank protrudes downward from the upper face (31) of the ultrasonic wave guide chamber, and the cleaning tank stands vertically so that an upper portion of the cleaning tank extends upward from the upper face (31) of the ultrasonic wave guide chamber.

According to this aspect, the constitution of the ultrasonic cleaning device of the present invention can be more specifically realized.

According to a fourth aspect of the present invention, in any one of the first to the third aspects, the cleaning tank is arranged at a substantial center of the ultrasonic wave guide chamber.

According to this aspect, the ultrasonic force concentrated by the ultrasonic wave guide chamber can be collected to the cleaning tank. Therefore, the cleaning force can be enhanced.

According to a fifth aspect of the present invention, in any one of the first to the fourth aspects, an ultrasonic wave guide gap adjustment valve (9) for adjusting a liquid level of the cleaning solution (an ultrasonic wave guide gap (13)) in the ultrasonic wave guide chamber is arranged on the upper face (31) of the ultrasonic wave guide chamber.

According to the present aspect, when the liquid level of the cleaning solution (an ultrasonic wave guide gap) in the ultrasonic wave guide chamber is adjusted by the ultrasonic wave guide gap adjustment valve, the ultrasonic force can be most appropriately condensed and collected.

According to a sixth aspect of the present invention, in any one of the first to the fifth aspects, a cleaning solution flows in the order of the cleaning tank and the ultrasonic wave guide chamber in the ultrasonic cleaning device.

According to the present aspect, as the cleaning solution flows in the order of the cleaning tank and the ultrasonic wave guide chamber, foreign objects, which have been removed by cleaning, can be quickly exhausted. Accordingly, a state of the cleaning solution in the vicinity of the object to be cleaned can be maintained clean. As a result, the cleaning effect can be improved.

According to a seventh aspect of the present invention, in any one of the first to the sixth aspects, an ultrasonic cleaning device further comprises a main body tank (30) for accommodating the ultrasonic wave guide chamber and the cleaning tank. The ultrasonic oscillation plate is arranged on a bottom face of the main body tank (30) so that the ultrasonic oscillation plate can be opposed to the ultrasonic wave guide chamber.

According to the present aspect, a preferable aspect of the ultrasonic cleaning device of the present invention is clarified.

According to an eighth aspect of the present invention, in the seventh aspect, a solution discharge gap (12), which is formed between the ultrasonic wave guide chamber and an inner surface of the bottom face (2) of the main body tank, is 0.1 to 3 mm.

According to the present aspect, the solution discharge gap can be appropriately set. Therefore, in the case where the cleaning solution is made to flow through the ultrasonic cleaning device, a liquid level (the cleaning solution depth) of the cleaning solution in the cleaning tank can be maintained so that an appropriate cleaning condition is provided.

According to a ninth aspect of the present invention, in the seventh or the eighth aspect, an ultrasonic cleaning device further comprises: a circulation pump (7); and a circulation tank (8). The cleaning solution is stored in the circulation tank and sucked from the circulation tank by the circulation pump and made to flow in the order of the cleaning tank, the ultrasonic wave guide chamber and the main body tank and return to the circulation tank.

According to the present aspect, the cleaning solution flows through the ultrasonic cleaning device in the order of the cleaning tank, the ultrasonic wave guide chamber and the main body tank. Therefore, foreign objects, which have been removed by cleaning, can be quickly exhausted. Accordingly, a state of the cleaning solution in the vicinity of the object to be cleaned can be always maintained clean. As a result, the cleaning effect can be improved.

According to a tenth aspect of the present invention, in any one of the seventh to the ninth aspects, an ultrasonic cleaning device further comprises a level gauge (6) for measuring a cleaning solution depth (14) in the cleaning tank, wherein the ultrasonic cleaning device is controlled so that the cleaning solution depth (14) in the cleaning tank can be maintained at an appropriate value.

According to the present aspect, when it is controlled so that the cleaning solution depth (14) in the cleaning tank can be maintained at an appropriate value, the cleaning condition can be more appropriately set and the cleaning effect can be improved.

According to an eleventh aspect of the present invention, an ultrasonic cleaning method comprises: a step of transmitting oscillations, which are generated by a plurality of ultrasonic oscillators (1), to a cleaning solution (20) via an ultrasonic oscillation plate (2) having the plurality of ultrasonic oscillators (1); a step of collecting an ultrasonic wave force of the oscillations transmitted from the ultrasonic oscillation plate via an ultrasonic wave guide chamber (3) in which the cleaning solution is accommodated; and a step of cleaning an object (5) to be cleaned, which is dipped in the cleaning solution stored in a cleaning tank (4) joined to the ultrasonic wave guide chamber, by the ultrasonic wave force.

When the ultrasonic wave guide chamber is provided as described above and the step is provided in which the ultrasonic force generated by a plurality of ultrasonic oscillators is condensed and concentrated on the cleaning tank, it is possible to enhance a cleaning force (ability) without causing a problem, such as a damage and failure of the ultrasonic oscillator and the ultrasonic generator, which could be a problem encountered when an ultrasonic cleaning force is strengthened in a device of the prior art. Accordingly, the cleaning speed can be remarkably enhanced as compared with the cleaning speed of the conventional ultrasonic cleaning method, and the cleaning device can be downsized and the cost of cleaning can be reduced.

According to a twelfth aspect of the present invention, in the eleventh aspect, an ultrasonic cleaning method further comprises a step of circulating the cleaning solution in such a manner that the cleaning solution stored in a circulation tank (8) is sucked by a circulation pump (7) so as to make the cleaning solution flow in the order of the cleaning tank and the ultrasonic wave guide chamber and then return to the circulation tank (8).

According to this aspect, as the cleaning solution flows through the device in the order of the cleaning tank and the ultrasonic wave guide chamber, foreign objects, which have been removed by cleaning, can be quickly exhausted. Therefore, the cleaning solution in the vicinity of the object to be cleaned can be always maintained in a clean state. As a result, the cleaning effect can be improved.

According to a thirteenth aspect of the present invention, in the twelfth aspect described above, an ultrasonic cleaning method further comprises a step of controlling to maintain the cleaning solution depth (14) in the cleaning tank at an appropriate value by comprising a level gauge (6) for measuring the cleaning solution depth (14) in the cleaning tank.

According to the present aspect, when the cleaning solution depth (14) in the cleaning tank is controlled so that it can be maintained at an appropriate value, the cleaning condition can be more appropriately set and the cleaning effect can be improved.

According to a fourteenth aspect of the present invention, in any one of the eleventh to the thirteenth aspects, an ultrasonic cleaning method further comprises a step of adjusting a liquid level of the cleaning solution (an ultrasonic wave gap (13)) in the ultrasonic wave guide chamber by an ultrasonic wave guide gap adjusting valve (9) provided on an upper face (31) of the ultrasonic wave guide chamber.

According to the present aspect, when the liquid level of the cleaning solution (the ultrasonic wave guide gap) in the ultrasonic wave guide chamber is adjusted, the condensation and the concentration of the ultrasonic force can be improved.

In the explanations of the present invention described above, reference symbols and numerals in the parentheses are attached corresponding to the embodiments shown as follows.

The present invention may be more fully understood from the description of the preferred embodiments of the invention set forth below, together with the accompanying drawings.

DESCRIPTION OF THE PREFERRED EMBODIMENTS

Figure 1:
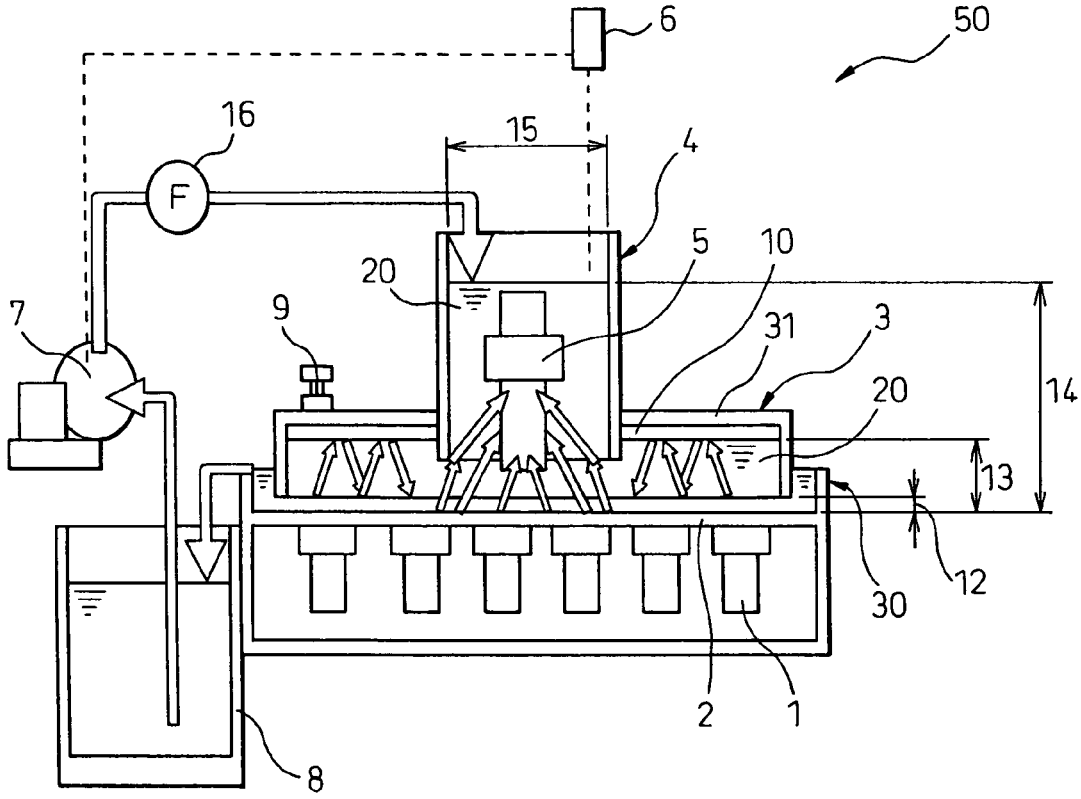
FIG. 1 is a schematic illustration schematically showing a constitution of an embodiment of the ultrasonic cleaning device of the present invention.

Referring to the drawings, an embodiment of the ultrasonic cleaning device and method of the present invention will be explained in detail as follows. FIG. 1 is a schematic illustration schematically showing a constitution of an embodiment of the ultrasonic cleaning device of the present invention.

Referring to FIG. 1, an ultrasonic cleaning device 50, which is an embodiment of the present invention, includes: a plurality of ultrasonic oscillators 1; an ultrasonic oscillation plate 2 for transmitting an ultrasonic force, which has been generated by the plurality of ultrasonic oscillators 1, to a cleaning solution 20; an ultrasonic wave guide chamber 3 formed by an ultrasonic wave guide tank for collecting the ultrasonic force; a cleaning tank 4 forming a cleaning chamber for dipping and cleaning an object 5 to be cleaned; and a main body tank 30 forming a main chamber for accommodating the cleaning tank 4 and the ultrasonic wave guide chamber 3. In the present embodiment, in the main body tank 30, the ultrasonic wave guide chamber 3 is arranged in such a manner that it is spaced from a bottom face (the ultrasonic oscillation plate) 2 of the main body tank 30. The ultrasonic wave guide chamber 3 is a bowl-shaped container, the upper face 31 of which is closed. The cleaning tank 4 is arranged at the substantial center of the ultrasonic wave guide chamber 3. As shown in FIG. 1, a portion (a lower portion) of the cleaning tank 4 penetrates an upper face 31 of the ultrasonic wave guide chamber 3 and protrudes inside the chamber 3 while not exceeding a lower end level of the chamber 3. The cleaning tank 4 stands vertically in such a manner that the upper portion of the cleaning tank 4 extends upward from the upper face 31. The cleaning tank 4 is joined to the ultrasonic wave guide chamber 3. The ultrasonic wave guide chamber 3 includes a ultrasonic wave-guide gap adjustment valve 9 which is arranged on the upper face 31. The ultrasonic wave-guide gap adjustment valve 9 is an adjustment valve for properly adjusting an ultrasonic wave guide gap 13 which will be explained later.

In the present embodiment, the bottom face of the main body tank 30 serves as the ultrasonic oscillation plate 2. Onto the bottom face (the ultrasonic oscillation plate) 2, a plurality of ultrasonic oscillators 1 are attached. In the present embodiment, the number of the ultrasonic oscillators 1 is six. However, the number of the ultrasonic oscillators 1 is not limited to six. It is preferable that the ultrasonic oscillators 1 are arranged in a range of the ultrasonic wave guide chamber 3 in a plan view. The main body tank 30, the ultrasonic wave guide chamber 3 and the cleaning tank are filled with a cleaning solution 20 such as water or solvent. Oscillations generated by the ultrasonic oscillators 1 are transmitted to the cleaning solution 20 via the ultrasonic oscillation plate 2. Therefore, the object 5 to be cleaned is cleaned by cavitation (ultrasonic force), etc. generated in the cleaning solution 20.

The ultrasonic cleaning device 50 further includes: a circulation pump 7; a circulation tank 8; a filter device 16; and a level gauge 6. The circulation tank 8 stores a cleaning solution 20 which circulates in the device. The circulation pump 7 sucks the cleaning solution 20 from the circulation tank 8 and supplies the cleaning solution 20, which is cleaned through the filter device 16, into the cleaning tank 4 at all times, so that a depth of the cleaning solution in the cleaning tank 4 can be properly maintained. The level gauge 6, which measures and confirms a depth of the cleaning solution 20 in the cleaning tank 4, may be one of the various well known level gauges. For example, the level gauge 6 may be of an optical type, such as a laser beam type, an ultrasonic type, an electric type, such as an electrostatic type, or a mechanical type, such as a float type. The filter device 16 is arranged in a line of the circulation pump 7 and conducts filtering of a contaminated cleaning solution 20 so as to clean it.

In the ultrasonic cleaning device 50, when an upper portion of the ultrasonic wave guide chamber 3 is airtightly closed by the upper face 31, an air layer 10 is formed in the ultrasonic wave guide chamber 3. Oscillations generated by the plurality of ultrasonic oscillators 1 are reflected on a boundary between the air layer 10 and the cleaning solution 20 and then condensed and collected, so that the ultrasonic force can be strengthened. On the other hand, in the cleaning tank 4 of the present embodiment, as described before, the plurality of ultrasonic oscillators 1 are arranged and the ultrasonic wave guide chamber 3 is provided. Due to this structure, an ultrasonic force strengthening area 11 is formed in the vicinity of the object 5 to be cleaned. The ultrasonic force strengthening area 11 is a place where the ultrasonic force is collected and strengthened due to the constitution of the present invention. As the ultrasonic wave guide chamber 3 is arranged so as to be spaced away from the bottom face (the ultrasonic oscillation plate) 2 of the main body tank 30 as described before, as shown in FIG. 1, a solution discharge gap 12 is formed between the ultrasonic wave guide chamber 3 and the bottom face (the ultrasonic oscillation plate) 2 of the main body tank 30. The solution discharge gap 12 is a space in which foreign objects, which have been separated from the object 5 to be cleaned by a cleaning force, and the cleaning solution 20 containing the foreign objects are discharged uniformly from all the circumference of the bottom of the ultrasonic wave guide chamber 3. It is preferable that the solution discharge gap 12 is usually 0.1 to 3 mm. When the solution discharge gap 12 is properly set, a level of the cleaning solution in the cleaning tank 4 can be set at a proper depth.

As shown in FIG. 1, the cleaning solution depth 14 in the cleaning tank 4 is a distance from the inner face of the bottom face 2 of the main body tank 30 to the level of the cleaning solution in the cleaning tank 4. It has already been known that the cleaning solution depth 14 in the cleaning tank 4 has an influence on the cleaning effect. The depth 14 of the cleaning solution in the cleaning tank 4 is maintained so that a cleaned portion of the object 5 to be cleaned can be dipped in the cleaning solution and the most appropriate condition can be set to provide a cleaning effect. In the present embodiment, the depth 14 of the cleaning solution in the cleaning tank 4 is set at 75 mm. In this connection, in an actual test example, the depth 14 of the cleaning solution in the cleaning tank 4 was set at 75 mm. The ultrasonic wave guide gap 13 is a distance from the inner face of the bottom face 2 of the main body tank 30 to the liquid level of the cleaning solution in the ultrasonic wave guide chamber 3. It was already known that this ultrasonic wave guide gap 13 has an influence on the ultrasonic force and, as a result, on the cleaning effect. It is preferable that this ultrasonic wave guide gap 13 is set at the most appropriate condition for guiding the ultrasonic force to the cleaning tank 4 arranged at the center. In the present embodiment, this ultrasonic wave guide gap 13 is set at 3 to 20 mm. In the present embodiment, the cleaning tank 4 is cylindrical. It is preferable that the cleaning tank diameter 15 is set at the most appropriate value for compounding, condensing and concentrating the reflected ultrasonic force. In the present embodiment, the diameter is 75 mm. In an actual test example, the diameter was set at 75 mm. The cleaning tank 4 may have another tubular (cylindrical) shape with a sectional area, other than circular, for example, a square, a hexagon, an ellipse or the like. In this case, the equivalent diameter of the tube (cylinder) should be the same as that of the circular tubular (cylindrical) shape. The aforementioned cleaning solution depth 14, the ultrasonic wave guide gap 13 and the cleaning tank diameter 15 are not restricted to the above values and may be appropriately selected according to the size of the object 5 to be cleaned.

The operation of the present invention having the above constitution is explained below. Based on the cleaning solution depth measured by the level gauge 6, the flow rate of the circulated cleaning solution supplied to the small cleaning tank 4 is adjusted so that the cleaning solution depth can be set at the most appropriate value. In order to adjust the flow rate of the circulating cleaning solution, it is possible to employ a well known means, for example, a flow rate of the circulating pump is adjusted or a flow rate adjustment valve is provided in the piping system. Alternatively, an upper face of the cleaning solution in the cleaning tank 4 may be adjusted so as to maintain the most appropriate depth by a method in which the cleaning solution in the cleaning tank 4 overflows a little. This method is not shown in the drawing. In this way, the cleaning solution is circulated and the cleaning solution depth 14 can be maintained at an appropriate value by an appropriate liquid flow resistance based on the solution discharge gap 12. In this state, first of all, the object 5 to be cleaned is put into the cleaning tank 4 in which the ultrasonic cleaning force is strengthened. Oil and fat and foreign objects attached to the object 5 to be cleaned are effectively separated from the object 5 to be cleaned by the cavitation effect (the ultrasonic force) of the ultrasonic wave that the ultrasonic oscillators 1 have generated. The thus separated foreign objects and others are discharged outside the cleaning tank 4 from the entire circumference thereof via the solution discharge gap 12 through the ultrasonic wave guide chamber 3 as the cleaning solution 20 flows and circulates. Although the vicinity of the object 5 to be cleaned in the cleaning tank 4 is a strengthened ultrasonic area 11, due to this flow of the cleaning solution, it is possible to maintain a clean state of the cleaning solution. Therefore, a rinse step can be shortened, that is, when rinsing is conducted only for several seconds, one object 5 to be cleaned can be cleaned, that is, one object 5 is directly conveyed out. Accordingly, cleaning can be completed at a remarkably higher cleaning speed than that of the conventional ultrasonic cleaning method.

Figure 2:
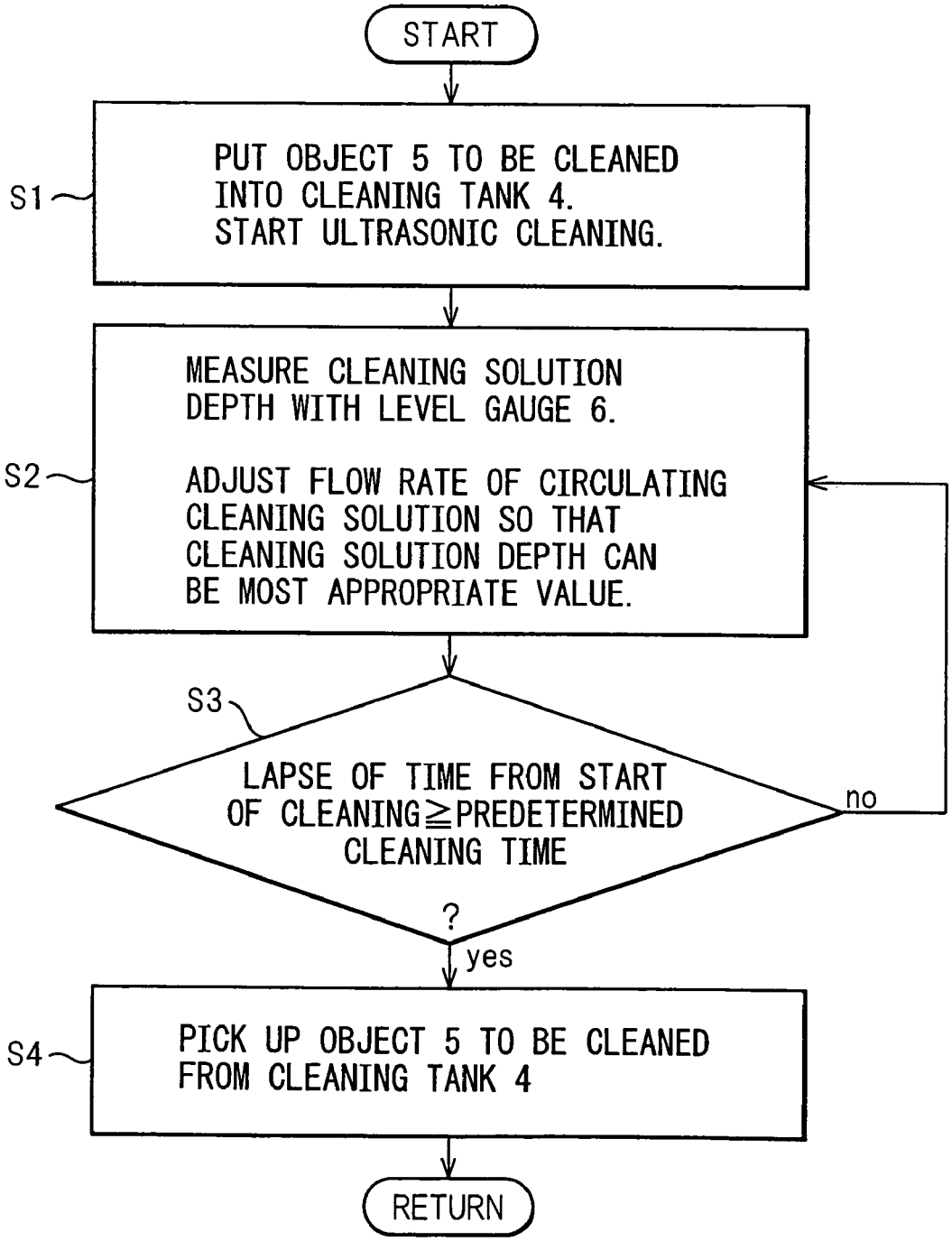
FIG. 2 is a flow chart for explaining a cleaning process in an embodiment of the present invention.

Next, referring to the flow chart shown in FIG. 2, the cleaning process of the present embodiment will be explained below. First of all, in step S1, the object 5 to be cleaned is put into the cleaning tank 4 and cleaning of the object 5 to be cleaned by ultrasonic waves is started. Next, in step S2, the cleaning solution depth in the cleaning tank 4 is measured by the level gauge 6, and a flow rate of the circulating cleaning solution is adjusted so that the cleaning solution depth in the cleaning tank 4 can be maintained at the most appropriate value. In step S3, it is judged whether or not a lapse of time from the start of cleaning of the object 5 to cleaned has reached a predetermined time. When it is judged in step S3 that the lapse of time from the start of cleaning of the object 5 to cleaned has not reached a predetermined cleaning time, the program returns to step S2, and the cleaning of the object 5 to be cleaned is continued while a flow rate of the circulating cleaning solution is adjusted so that the cleaning solution depth can be maintained at the most appropriate value. When it is judged in step S3 that the lapse of time from the start of cleaning of the object 5 to cleaned has reached the predetermined cleaning time, it is judged that the cleaning of the object 5 to be cleaned has been completed. Therefore, the program proceeds to step S4 and the object to be cleaned is picked up from the cleaning tank 4. In this connection, when ultrasonic waves are generated in step S1 before the object 5 to be cleaned is put into the cleaning tank, the above predetermined cleaning time can be shortened.

Next, the effect and operation of the above embodiment will be explained below. The following effects can be expected by the ultrasonic cleaning device of the above embodiment of the present invention.

When the ultrasonic wave guide chamber is provided and a mechanism in which the ultrasonic force is condensed and collected at the central small cleaning tank is applied, it is possible to enhance a cleaning force (ability) of the ultrasonic cleaning device without causing a problem of damage and failure of the ultrasonic oscillator and the ultrasonic generator which was a conventional problem caused when the ultrasonic cleaning force was strengthened in the prior art.

The above operation provides an effect, that is, it is possible to provide a cleaning method in which the cleaning speed of the ultrasonic cleaning device is remarkably enhanced and the cleaning device is downsized, in comparison with conventional devices and the cost of cleaning is reduced.

In the embodiment described above or shown in the accompanying drawings, in the ultrasonic cleaning device of the present invention, the cleaning solution flows and circulates in the cleaning device. However, the constitution may be composed in such a manner that the cleaning solution is not circulated through the cleaning device. That is, even when the circulation pump, the circulation tank and others are deleted, the present invention is effective.

In the above explanations, the most preferred embodiments of the ultrasonic cleaning device of the present invention are described. However, in order for the explanations to be easily understood, the constitution is simplified. Therefore, in order to give an additional function to the cleaning device of the present invention, additional components may be incorporated into the present invention, for example, various sensors, piping accessories and other accessories may be incorporated into the present invention.

While the invention has been described by reference to specific embodiments chosen for the purposes of illustration, it should be apparent that numerous modifications could be made thereto, by those skilled in the art, without departing from the basic concept and scope of the invention.

The invention claimed is:

1. An ultrasonic cleaning device comprising:

a main tank forming a main chamber, the main tank including an ultrasonic oscillation plate having a plurality of ultrasonic oscillators attached to the ultrasonic oscillation plate;

an ultrasonic wave guide tank forming an ultrasonic wave guide chamber disposed within the main tank, the ultrasonic wave guide chamber being in communication with the main chamber;

a cleaning tank forming a cleaning chamber in communication with the ultrasonic wave guide chamber for cleaning an object; and a cleaning solution disposed in the main chamber, the ultrasonic wave guide chamber and the cleaning chamber; wherein an upper portion of the ultrasonic wave guide chamber is airtightly closed by an upper face of the ultrasonic wave guide tank, the cleaning tank is attached to the ultrasonic wave guide tank, an air layer is formed between a liquid level of the cleaning solution in the ultrasonic wave guide chamber and the upper face of the ultrasonic wave guide tank, the ultrasonic oscillation plate opposes the ultrasonic wave guide chamber; and a lower portion of the cleaning tank protrudes downward from the upper face of the ultrasonic wave guide tank, and an upper portion of the cleaning tank extends upward from the upper face of the ultrasonic wave guide tank.

2. An ultrasonic cleaning device according to claim 1, wherein the cleaning tank is arranged at a geometric center of the ultrasonic wave guide chamber.

3. An ultrasonic cleaning device according to claim 1, wherein an adjustment valve for adjusting a liquid level of the cleaning solution in the ultrasonic wave guide chamber is arranged on the upper face of the ultrasonic wave guide tank.

4. An ultrasonic cleaning device according to claim 1, wherein the cleaning solution flows from the cleaning chamber to the ultrasonic wave guide chamber.

5. An ultrasonic cleaning device according to claim 1, wherein the ultrasonic oscillation plate is arranged on a bottom face of the main tank so that the ultrasonic oscillation plate opposes the ultrasonic wave guide chamber.

6. An ultrasonic cleaning device according to claim 5, wherein a gap formed between the ultrasonic wave guide tank and an inner surface of a bottom face of the main tank, is 0.1 to 3 mm.

7. An ultrasonic cleaning device according to claim 5, further comprising: a circulation pump; and a circulation tank, wherein cleaning solution stored in the circulation tank is pumped from the circulation tank by the circulation pump to flow to the the cleaning tank, the ultrasonic wave guide tank and the main tank and return to the circulation tank.

8. An ultrasonic cleaning device according to claim 5, further comprising a level gauge for measuring a cleaning solution depth in the cleaning tank.

* * * * *